US011251542B2

(12) United States Patent
Baur et al.

(10) Patent No.: US 11,251,542 B2
(45) Date of Patent: Feb. 15, 2022

(54) ANTENNA ARRAY FOR A RADAR SENSOR

(71) Applicant: Robert Bosch GmbH, Stuttgart (DE)

(72) Inventors: Klaus Baur, Mietingen (DE); Marcel Mayer, Lonsee (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/965,991

(22) PCT Filed: Dec. 14, 2018

(86) PCT No.: PCT/EP2018/084892
§ 371 (c)(1),
(2) Date: Jul. 29, 2020

(87) PCT Pub. No.: WO2019/158251
PCT Pub. Date: Aug. 22, 2019

(65) Prior Publication Data

US 2020/0358207 A1 Nov. 12, 2020

(30) Foreign Application Priority Data

Feb. 15, 2018 (DE) ..... 10 2018 202 299.2

(51) Int. Cl.
*H01Q 1/32* (2006.01)
*H01Q 25/00* (2006.01)
(Continued)

(52) U.S. Cl.
CPC ..... *H01Q 25/001* (2013.01); *H01Q 21/0037* (2013.01); *H01Q 21/0075* (2013.01);
(Continued)

(58) Field of Classification Search
CPC ..... H01Q 25/001; H01Q 25/002; H01Q 21/0037; H01Q 21/0075; H01Q 21/065;
(Continued)

(56) References Cited

U.S. PATENT DOCUMENTS

2011/0285573 A1* 11/2011 Jeong ..... H01Q 21/065 342/70
2017/0363713 A1* 12/2017 Kim ..... H01Q 1/3233

FOREIGN PATENT DOCUMENTS

DE 102017210137 A1 12/2017
JP 2006527557 A 11/2006
JP 2008005164 A 1/2008

OTHER PUBLICATIONS

J.R. James et al.: "Chapter 1—Introduction", In: Handbook of Microstrip Antennas, Jan. 1, 1989, Peter Peregrinus Ltd., London, GB, pp. 1-44.

(Continued)

*Primary Examiner* — Seokjin Kim
(74) *Attorney, Agent, or Firm* — Norton Rose Fulbright US LLP; Gerard Messina

(57) ABSTRACT

An antenna array for a radar sensor, having an antenna designed as a group antenna and operable as a transmit antenna and having an antenna configuration operable as a receive antenna, wherein the array has, in addition to the first antenna designed as a group antenna, a second antenna operable as a transmit antenna that has a smaller aperture than the first antenna, and the first and second antenna are designed for the transmission of radar waves having polarization orthogonal to one another, and the antenna configuration operable as a receive antenna is sensitive to both directions of polarization.

9 Claims, 1 Drawing Sheet

(51) Int. Cl.
*H01Q 21/00* (2006.01)
*H01Q 21/06* (2006.01)

(52) U.S. Cl.
CPC ..... *H01Q 21/065* (2013.01); *H01Q 25/002* (2013.01); *H01Q 1/3233* (2013.01)

(58) Field of Classification Search
CPC ... H01Q 21/24; H01Q 21/0006; H01Q 1/3233
See application file for complete search history.

(56) References Cited

OTHER PUBLICATIONS

J.R. James et al., "Microstrip antennas and arrays. Pt. 2—New array-design technique", IEEE Journal on Microwaves, Optics and Acoustics, vol. 1, Issue 5, Sep. 1, 1977, pp. 175-181.
International Search Report for PCT/EP2018/084892, dated Mar. 4, 2019.

* cited by examiner

ANTENNA ARRAY FOR A RADAR SENSOR

FIELD

The present invention relates to an antenna array for a radar sensor, having an antenna fashioned as a group antenna and capable of being operated as a transmit antenna, and having an antenna configuration capable of being operated as a receive antenna.

BACKGROUND INFORMATION

In particular, the present invention relates to radar sensors that are used in motor vehicles in order to locate vehicles traveling in front and other objects, and that have a relatively large range of 120 m or more.

Conventional antenna arrays for such radar sensors have, as a transmit antenna or as a combined transmit and receive antenna, a group antenna having a relatively large aperture that produces a radar lobe that is relatively strongly focused at least in the azimuth. Conventional arrays, in addition to the strongly focusing transmit antenna, have a plurality of receive antennas are provided having a small aperture, which are able to also receive radar echoes in a larger angular region around the main direction of radiation (0° direction) of the antenna array.

However, the directional characteristic of the strongly focusing group antenna has pronounced minima or null points already at relatively small angles on both sides of the 0° direction, so that the radar sensor is practically blind to objects situated in this direction. Typically, these null points in the directional characteristic are situated at the azimuth angles on the order of ±30°.

In order to achieve a larger field of view of the radar sensor system, up to now it has been standard to combine the long-range radar sensor with one or more short-range radar sensors that have a larger location angular range.

Another possibility for enlarging the region free of null points around the 0° direction in a long-range radar sensor is to suitably taper the individual antenna columns of the group antenna. This means that the width and height of the individual antenna patches within the antenna column are varied. Due to unavoidable manufacturing tolerances in the manufacturing of such antenna arrays, however, it is difficult to produce antenna arrays having a specified directional characteristic in a reproducible fashion.

SUMMARY

An object of the present invention is therefore to provide an antenna array that, while having a large range, has an enlarged region free of null points around the 0° direction, and can be produced in reproducible fashion.

According to an example embodiment of the present invention, this object may achieved in that the example array has, in addition to the first antenna designed as a group antenna, a second antenna capable of being operated as a transmit antenna that has a smaller aperture than the first antenna, and that the first and the second antenna are designed for the transmission of radar waves having polarization orthogonal to one another, and that the antenna configuration capable of being operated as a receive antenna is sensitive to both polarization directions.

Due to the relatively widely fanned-out radar lobe emitted by the second transmit antenna, the null points in the antenna diagram of the first antenna are largely filled in. The use of orthogonal polarizations in the two transmit antennas prevents interference between the radar waves sent by the two antennas, which would again result in null points at particular angles. In this way, a gapless monitoring of the traffic environment in an expanded angular range is enabled.

Advantageous embodiments and developments of the present invention are described herein.

The antenna configuration operable as a receive antenna can be formed by the first and the second antenna, which are also used to transmit the radar waves. Optionally, however, it is also possible to use separate antennas for transmission and for reception.

In a specific example embodiment of the present invention, the second antenna has, in the azimuth, a smaller aperture than the first antenna, so that an expanded location angular range in the azimuth is obtained. However, specific embodiments are also possible in which the second antenna has a smaller aperture in elevation than the first antenna, so that an expanded location angular range in elevation is obtained.

In a typical radar sensor for motor vehicles, when the radar waves pass through the radome of the radar sensor and/or through the bumper of the vehicle there is a certain degree of attenuation that is a function of the polarization direction of the radar waves. Preferably, therefore, the polarization directions orthogonal to one another are selected such that the attenuation at the radome and/or bumper is minimized. In many cases, in addition a vertical polarization of the radiation emitted by the first antenna having the larger aperture is advantageous.

In another useful specific embodiment of the present invention, the first antenna is formed by a group antenna having a plurality of parallel antenna columns, while the second antenna is formed by a single antenna column. As a rule, here it is advantageous if the so-called phase source points of the two antennas, i.e., the electronic reference points of the antennas, are situated at the same position. In this way, it is achieved that even given angles deviating strongly from the 0° direction (and also given incomplete polarization decoupling), destructive interference does not occur. If the null-point-free region of the directional characteristic does not have to be quite so large, however, there can also be a certain offset between the phase source points, if this is desirable for other reasons.

The plurality of columns of the group antenna and the individual columns of the second antenna can optionally be fed serially or also centrally. In each case, the amplitude ratio of the feeding between the individual column and the group antenna is a parameter via which the weighting between the range of the radar sensor and the size of the null-point-free angular region can be adapted as needed.

In a specific example embodiment of the present invention, the antenna configuration operable as a receive antenna includes a first receive antenna designed as a group antenna that has, for the polarization direction of the first transmit antenna, a higher sensitivity than for the polarization direction of the second transmit antenna, and includes a second receive antenna having a smaller aperture that has a higher sensitivity for the polarization direction of the second transmit antenna than for the polarization direction of the first antenna. Here, the first receive antenna can be identical with the first transmit antenna, and the second receive antenna can be identical with the second transmit antenna (monostatic antenna design).

In still another specific example embodiment of the present invention, the antenna configuration operable as a receive antenna is designed to be polarization-pure, i.e., each of at least two receive antennas is practically sensitive only to one of the two polarization directions, so that twice the number of evaluation channels are available, and both the far range and the near range can be covered with a single radar sensor.

Below, exemplary embodiments of the present invention are explained in more detail on the basis of the figures.

DETAILED DESCRIPTION OF EXAMPLE EMBODIMENTS

Figure 1:
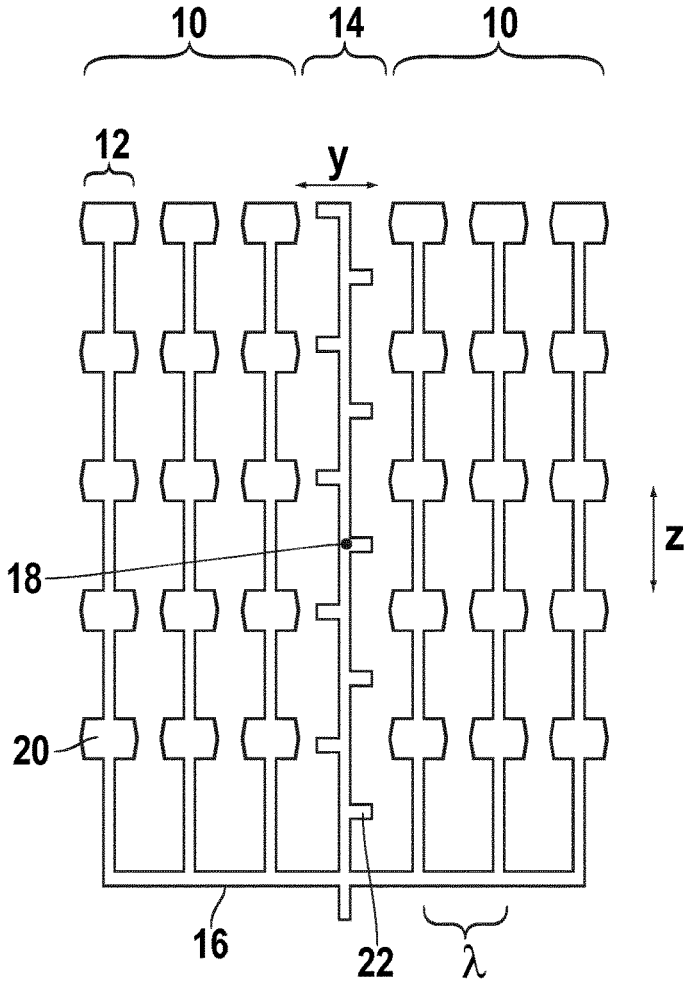
FIG. 1 shows an example of an antenna array according to the present invention.

The example antenna array shown in FIG. 1 has a first antenna 10 in the form of a planar group antenna having six parallel antenna columns 12. The six antenna columns 12 are divided into two groups each having three columns, between which there is a gap that is filled by a second antenna 14.

The six columns of first antenna 10 and the individual columns of second antenna 14 are fed serially by a common feed network 16 with a radio-frequency signal having wavelength A. The connection points of all seven antenna columns to feed network 16 are situated at uniform distances that correspond to wavelength A, so that all antenna columns obtain signals having the same phase. The connection point of the single-column antenna 14 is situated centrically between the connection points of antenna columns 12, and first antenna 10 and second antenna 14 have a common phase source point 18.

Each antenna column 12 of the first antenna is made up, in the depicted example, of five antenna patches 20 tapered in the vertical direction (or optionally also, or only, in the horizontal direction), each having height $\lambda/2$. First antenna 10 thus emits radar radiation polarized in a first polarization direction z.

As an example, it can be assumed that the antenna array is formed on a circuit board of a radar sensor that is installed in a motor vehicle in such a way that the circuit board, and thus the plane of antennas 10, 14, is oriented vertically, and the normal to this plane runs parallel to the longitudinal axis of the vehicle. The radar radiation of the first antenna 10 is then thus polarized vertically, and, due to the large aperture of antenna 10 in the azimuth, the radiation is sharply focused in the horizontal direction.

However, second antenna 14, formed by an individual column, has ten patches 22 that go out at a right angle from the associated feed line (alternating in opposite directions), and thus emit radar radiation that is linearly polarized in linear fashion in a second polarization direction y at a right angle to first polarization direction z. Because the aperture of second antenna 14 in the azimuth is only about 1/7 of the aperture of first antenna 10, the radiation emitted by second antenna 14 in the azimuth is relatively widely fanned out, so that—with a smaller range—a significantly larger angular region is covered than with the radar radiation of first antenna 10.

As an example, it can be assumed that first antenna 10 and second antenna 14, in the radar sensor considered here, have both the function of transmit antennas and the function of receive antennas. The received radar echo is then coupled out, in a conventional manner, using a coupler connected to feed network 16, and is separated from the transmit signal, so that from the two antennas 10, 12 together one obtains only a single receive signal in a single evaluation channel.

Figure 2:
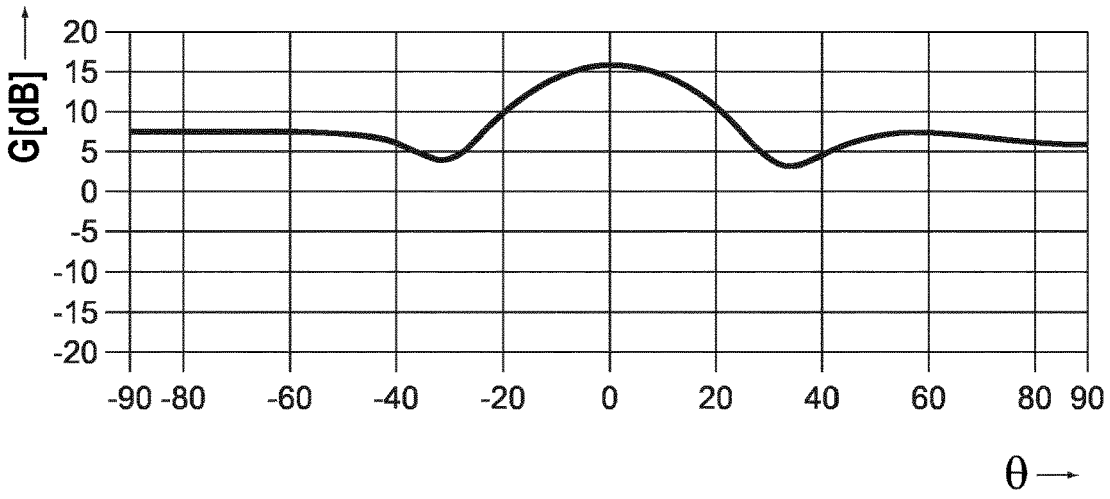
FIG. 2 shows a directional characteristic of the antenna array of FIG. 1.

FIG. 2 graphically shows the directional characteristic of the antenna array shown in FIG. 1. This directional characteristic indicates the antenna gain G as a function of the azimuth angle $\theta$. It will be seen that the gain has a maximum at azimuth angle 0°, flanked by minima at approximately ±30°, but overall has only relatively small fluctuations. If the directional characteristic of first antenna 10 is instead regarded by itself, then there would be significantly more pronounced minima at approximately ±30°, so that practically no signal would then be detectable from objects situated at these angles. These gaps are filled by the signal of second antenna 14. Thus, the present invention enables a reliable location of objects over a very large azimuth angle range, the sensitivity being only slightly lower even in the vicinity of the minima at ±30°.

In another specific example embodiment, a bistatic antenna design can also be realized in which the antenna array shown in FIG. 1 is present at least twice, once as a transmit antenna and once as a receive antenna.

In addition, an antenna array would also be possible in which the array shown in FIG. 1 having antennas 10 and 14 is used as a transmit antenna, and two separate receive antennas are provided for the reception of the radar signals, of which one is sensitive exclusively to vertical polarization direction z and the other is sensitive exclusively to horizontal polarization direction y. In this case, the different polarized radar echoes can be evaluated separately in two receive channels, the one receive channel corresponding to a long-range sensor and the other receive channel corresponding to a near-range sensor.

What is claimed is:

1. An antenna array for a radar sensor, comprising:

a first antenna, which is configured as a planar group antenna having a plurality of parallel antenna columns, and which is operable as a transmit antenna;

an antenna configuration, which is operable as a receive antenna; and a second antenna, which is operable as a transmit antenna that has a smaller aperture than the first antenna, wherein the first antenna and second antenna are configured to transmit radar waves having polarization orthogonal to one another, wherein the plurality of antenna columns includes groups of the antenna columns, each of the groups having fewer of the antenna columns than the plurality of antenna columns, wherein there is a gap between the groups and wherein the gap is filled by the second antenna;

wherein the antenna configuration, which is operable as the receive antenna is sensitive to both directions of polarization.

2. The antenna array as recited in claim 1, wherein the second antenna has a smaller aperture in azimuth than the first antenna.

3. The antenna array as recited in claim 1, wherein the first antenna and the second antenna have a common phase source point.

4. The antenna array as recited in claim 1, wherein the first antenna has a plurality of antenna columns having a plurality of antenna patches, wherein the second antenna has at least one antenna column having a plurality of antenna patches, and wherein the number of antenna columns of the second antenna is smaller than that of the first antenna.

5. The antenna array as recited in claim 4, wherein the antenna patches of the first antenna are shaped such that they emit radar waves whose polarization direction is parallel to a longitudinal direction of the antenna columns of the first antenna, and wherein the second antenna has antenna patches that are shaped such that they emit radar waves whose polarization direction is at a right angle to a longitudinal direction of the antenna column of the second antenna.

6. The antenna array as recited in claim 1, wherein the first antenna and the second antenna are part of the antenna configuration, which is operable as the receive antenna.

7. The antenna array as recited in claim 6, wherein the first antenna and the second antenna are fed from a common feed network, and which, as receive antennas, supply a uniform receive signal.

8. The antenna array as recited in claim 1, wherein the antenna configuration, which is operable as the receive antenna has at least two antennas, which are different from the first antenna and the second antenna, and which are each selectively sensitive to one of the two polarization directions.

9. A radar sensor for motor vehicles, comprising:

an antenna array for the radar sensor, including:

a first antenna, which is configured as a planar group antenna having a plurality of parallel antenna columns, and which is operable as a transmit antenna;

an antenna configuration, which is operable as a receive antenna; and a second antenna, which is operable as a transmit antenna and which has a smaller aperture than the first antenna, wherein the first antenna and second antenna are configured to transmit radar waves having polarization orthogonal to one another, wherein the plurality of antenna columns includes groups of the antenna columns, each of the groups having fewer of the antenna columns than the plurality of antenna columns, wherein there is a gap between the groups and wherein the gap is filled by the second antenna;

wherein the antenna configuration, which is operable as the receive antenna is sensitive to both directions of polarization.

* * * * *